United States Patent [19]

Schuurmans

[11] Patent Number: 4,961,240

[45] Date of Patent: Oct. 9, 1990

[54] BACKPART MOULDING AND HEEL SEAT LASTING MACHINE

[75] Inventor: Marinus E. Schuurmans, Waalwijk, Netherlands

[73] Assignee: British United Shoe Machinery Ltd., Leicester, England

[21] Appl. No.: 320,174

[22] Filed: Mar. 7, 1989

[30] Foreign Application Priority Data

Mar. 31, 1988 [GB] United Kingdom ..... 8807667

[51] Int. Cl.[5] ..... A43D 21/08; A43D 21/00

[52] U.S. Cl. ..... 12/12.5; 12/14.4

[58] Field of Search ..... 12/12.3, 12, 12.5, 14.2, 12/14.4, 7

[56] References Cited

U.S. PATENT DOCUMENTS

| | | | |
|---|---|---|---|
| 3,005,216 | 10/1961 | Deschenes | 12/12.3 |
| 3,138,810 | 6/1964 | Becker | 12/14.4 |
| 3,234,574 | 2/1966 | Becker et al. | 12/14.2 |
| 3,271,800 | 9/1966 | Allard | 12/12.5 |
| 3,399,412 | 9/1968 | Allard | 12/14.2 |
| 4,485,512 | 12/1984 | Flanders et al. | 12/14.4 |
| 4,602,398 | 7/1986 | Giebel | 12/12.5 |
| 4,679,269 | 7/1987 | Becka et al. | 12/12.5 |

*Primary Examiner*—Steven N. Meyers

[57] ABSTRACT

The backpart of a shoe is moulded by a heel band (240) and at the same time the lasting marginal portions of the upper are wiped over and pressed by wiper plates (270) against corresponding marginal portions of the insole, bedding pressure being applied by the upthrust of the shoe support (10). The moulding and bedding times are independently settable, and at the end of the bedding time, and while mould clamping pressure is still being applied, the last pin (18) is retracted and the heel band (240) and wiper plates (270), still holding the shoe, are swung to an out-of-the-way position, the shoe being released, at the end of the moulding time, into a receptacle (346). Meanwhile the operating locatility is free for a further shoe to be loaded. A configuration of two such machines side-by-side with a common central receptacle (346) is described.

65 Claims, 7 Drawing Sheets

BACKPART MOULDING AND HEEL SEAT LASTING MACHINE

BACKGROUND OF THE INVENTION

This invention is concerned with improvements in or relating to backpart moulding and heel seat lasting machines.

One such machine is described in U.S. Patent Specification No. 3138810 and comprises a shoe support for supporting, bottom uppermost, a shoe comprising a shoe upper on a last and an insole on the last bottom, said support comprising a last pin which is received in a last pin hole formed in the crown of the last, a holddown, by which the heightwise position of the heel seat of a shoe supported by the shoe support is determined, the shoe support also comprising means for moving the last pin heightwise into and out of an operative position determined by the engagement of the heel seat of said shoe with the holddown, a heel band assembly, comprising a heel band which provides a moulding surface shaped complementarily to the heel end of the shoe to be operated upon and by which said heel end can be clamped and moulded, and a wiper assembly, comprising a pair of wiper plates and means for effecting forward and inward movement thereof whereby the wiper plates are effective to cause heel seat lasting marginal portions of the upper of a shoe the heel end of which has been clamped as aforesaid to be wiped over and pressed against corresponding marginal portions of the insole of said shoe whereby, with adhesive applied therebetween, said marginal portions are bonded together, said means also being effective to cause the wiper plates to be retracted at the end of their operation, and the arrangement being such that, with the wiper plates in an inwiped position, the holddown is retracted and increased pressure is applied to the shoe support thus to apply a bedding pressure to said marginal portions, wherein the heel band assembly and the wiper assembly are supported by a support arrangement, means being provided for effecting relative movement of approach between the shoe support and said support arrangement, to cause the heel end of a shoe supported by the shoe support to be engaged by the heel band, thus determining an operative relationship between the shoe support and the support arrangement, and for effecting relative movement of separation therebetween to a spaced relationship to facilitate the loading of a shoe on the shoe support.

More particularly in said Specification an apparatus is described comprising a central activator station and two operating stations each constituted by a machine as set out in the preceding paragraph, one for operating on left shoes and the other on rights. It will be appreciated that separate stations are preferably used for left and right shoes, since the heel band is preferably of different contour for each hand of shoe in order to achieve the best backpart moulding results. This is especially true where so-called "long" counters are used in the backpart of the shoe, that is to say stiffeners which extend well into the waist of the shoe.

In the use of the aforementioned apparatus, or more recent commercial derivatives thereof, the provision of the two stations means that the operator can, during the moulding time at one of the stations, unload and re-load the other station and also load the activator station, thereby creating a satisfactory workflow. Because of the relatively long moulding times required, however, it has been found that productivity of the machine is nevertheless restricted, since in general with a skilled operator there will be a significant waiting time during each cycle of operation.

OBJECT OF THE PRESENT INVENTION

It is thus the object of the present invention to provide an improved backpart moulding and heel seat lasting machine in the use of which productivity can be enhanced by mitigating the effect of the relatively long moulding times.

SUMMARY OF THE PRESENT INVENTION

The present invention thus provides, in one of its several aspects, a machine as set out in the first paragraph above, wherein the means for effecting heightwise movement of the last pin as aforesaid is effective to move the last pin in a direction away from the wiper plates out of its operative position prior to relative movement of separation being initiated between the shoe support and the support arrangement.

By this feature, it will be appreciated, a shoe being moulded is no longer held against movement away from the operating locality by the last pin projecting into the last pin hole of its last. Furthermore, in one embodiment of the invention the means for moving the last pin heightwise is caused to operate to move it in a direction away from the wiper plates as aforesaid prior to the release of the heel band and retraction of the wiper plates. Thus, in this case, with a shoe held clamped by the heel band, the wiper plates in overwipe condition and the holddown in its retracted condition, the last pin is retracted from the shoe last, whereafter relative movement is effected between the shoe support and the support arrangement out of said operative position thus to allow the continued. moulding of the backpart of the shoe and consolidation of the bond of said marginal portions while a further shoe is being loaded on the shoe support. In this way, it will be appreciated, the overall cycle time of the machine is reduced without reducing the moulding time, since the loading of a new shoe overlaps the moulding time of the previously loaded shoe.

It will be appreciated that such an arrangement could be difficult to achieve with high-legged boots, and consequently the machine preferably comprises selector means whereby the means for moving the last pin heightwise can be caused to operate to move it in a direction away from the wiper plates as aforesaid selectively either prior to the release of the heel band and retraction of the wiper plates relative to the support arrangement or after such release and retraction. That is to say, when operating on boots a more conventional operating cycle takes place.

In another of its aspects the present invention provides a backpart moulding and heel seat lasting machine wherein a shoe, comprising a shoe upper on a last and an insole on the last bottom, is supported by a shoe support at a height datum in relation to which a heel band, by which the backpart of the shoe can be clampingly engaged and thus moulded to the last, and also a wiper assembly, by which lasting marginal portions of the backpart of the shoe can be wiped over and pressed against corresponding marginal portions of the insole, are supported by a support arrangement, and wherein, in the operation of the machine, relative movement takes place between the shoe support and the support arrangement between a first relative postion thereof, in which the shoe support is rendered accessible for the loading of a shoe thereon, and a second relative position, in which the shoe supported at the height datum is engaged by the heel band, and further wherein, with the shoe clampingly engaged by the heel band and with the wiper assembly in its overwipe condition, relative movement takes place between the shoe support and the support arrangement to said first relative position thereof, whereby, while moulding of said shoe continues, a further shoe can be loaded on the shoe support.

In using the machine in accordance with the invention, the operator can preferably set the moulding time and/or the bedding time according to the needs which he perceives for a particular shoe. In one embodiment, therefore, conveniently there is provided timer means whereby the release of the heel band and retraction of the wiper plates can be delayed for a predetermined period following the heightwise movement of the last pin as aforesaid. In a machine where selector means is provided as aforesaid, such timer means will only operate when the "shoe" (as opposed to the "boot") cycle has been selected. In such a machine, furthermore, conveniently actuation of the timer means takes place in timed relation with the timing out of further timer means which is itself actuated in response to the actuation of the means for effecting relative movement of approach between the shoe support and the support arrangement as aforesaid.

In a preferred embodiment of the invention, however, there are provided first timer means actuatable in response to actuation of the means for effecting relative movement of approach between the shoe support and the support arrangement as aforesaid and effective, upon timing out, to cause the heel band to be released and the wiper plates to be retracted, and second timer means actuatable in timed relation with the application of increased pressure to the shoe support, the arrangement being such that if the first timer means times out before the second, the release of the heel band and retraction of the wiper plates are delayed until the relative movement of separation between the shoe support and the support arrangement has been completed. In this way, it will be appreciated, the operator can set both the bedding time and the moulding time according to what is perceived as needed for the particular shoe, without having to take into account also the relationship between the two times, but rather that relationship is taken care of by the machine control.

Conveniently the shoe support and support arrangement of the machine are so arranged that, in effecting relative movement of separation therebetween (i.e. relative movement to the first relative position thereof), such movement takes place in a direction extending transversely of the bottom of a shoe supported by the shoe support. This construction has been found to be advantageous in terms of the spatial arrangement of the various components of the machine. More particularly, in a preferred embodiment, the support arrangement comprises a frame, between which and the shoe support transverse movement can take place as aforesaid to move them between an operative (or second relative) position, in which the heel band assembly and the wiper assembly can operate on a shoe supported by the shoe support, and said spaced relationship (or first relative position), and also a carriage movable towards and away from the shoe support in the frame and supporting the heel band assembly and the wiper assembly for bodily movement between an advanced and a retracted position, the advanced position being determined, when the frame and shoe support are in said operative position, by engagement of the heel band with the heel end of a shoe supported by the shoe support (and thus determining the operative relationship between the shoe support and the support arrangement as aforesaid).

As in e.g. the machine described in GB-A1182773, preferably the heel band assembly also comprises band clamping means by which, after the band has engaged the shoe as aforesaid, the sides of the band are clamped against the sides of the shoe. Moreover, in the machine according to the present invention conveniently, after the last pin has been moved out of its operative position and prior to the transverse movement of the support arrangement, the carriage of the latter is moved to its retracted position, while the band clamping means maintains the heel band in clamping engagement with the shoe. Moreover, also in such a case the wiper plates are also maintained in their forward and inward position over the heel seat of the shoe during the retraction of the carriage. In this way, the heel band is caused securely to clamp the heel end of the shoe, after the retraction of the last pin, thus to maintain the moulding pressure on the backpart of the shoe, while at the same time the wiper plates serve to enhance the security of the clamping and also to maintain a reduced pressure (by virtue of the complementary shape of the heel band) on the inwiped marginal portions of the upper.

A significant portion of the operating cycle of the machine described in US-A3138810, or its commercial derivatives, is taken up by the need for the operator to unload the shoe and remove it, bearing in mind that at the time of unloading he will require two hands for the loading of the next shoe. In accordance with the present invention, therefore, there is provided a receptacle for a shoe, which receptacle is located beneath the support arrangement, when the latter is in its spaced relationship with the shoe support. Thus, upon the release of the heel band and retraction of the wipers, the shoe merely falls into the receptacle for subsequent removal by the operator when he does not have his hands fully occupied for the loading of the next shoe. The provision of the receptacle is of course most conveniently provided when the support arrangement is moved transversely to its spaced relationship with the shoe support, since then the receptacle can be fixed in an out-of-the-way position. It would however be possible in other arrangements for the receptacle to be moved in and out of an operative position, in timed relation with the operation of the machine, to receive a shoe when dropped from the heel band.

In the particular arrangement described above, where the carriage is retracted after the retraction of the last pin, conveniently the carriage is returned to its advanced position, after the support arrangement has moved transversely out of its operative relationship with the shoe support to its position above the receptacle, the band clamping means being operated to release the shoe from the heel band thus to allow the shoe to fall into the receptacle. Moreover, in such an arrangement preferably the retraction of the wiper plates is initiated before the operation of the band clamping means.

In the machine described in US-A3138810, it will be observed, the holddown is located at the operating locality during shoe loading, the shoe support being in a lowered position in relation thereto for allowing access for such loading. This disposition of the holddown is inconvenient, and consequently, in order to overcome this disadvantage, in the machine in accordance with the present invention preferably the holddown is mounted on the support arrangement for movement between an operative position, in which it serves to determine the heightwise position of the heel seat of a shoe supported by the shoe support, and a retracted position. In this way, the holddown, by virtue of its mounting on the support arrangement, is located away from the operating locality during the loading of a shoe on the shoe support, but is moved, with the support arrangement, to the latter's operative position whereat it can be lowered for setting a datum for the shoe bottom and thereafter be retracted to allow bedding pressure to be applied to the shoe bottom.

In using the machine described in US-A3138810 a significant proportion of the shoe loading time is taken up by the operator manually drawing the upper about its last, in particular by gripping the upper in the waist region thereof and drawing it toewardly and in a direction away from the shoe bottom so as to ensure that the backpart of the upper lies in a desirable location on its last prior to the operation of the heel band. In the commercial derivatives of the machine, gripping and tensioning means has been provided for gripping the upper in the forepart region thereof and applying a tensioning force, lengthwise of the shoe, to the upper to draw the backpart thereof about its last, and also heightwise of the shoe bottom. Nevertheless, in using such machines, the operator still manually applies an upward force to the upper in the waist region thereof and tends to hold it in that position as the heel band approaches, which can give rise to a risk of the operator having his fingers or thumbs trapped. In GB-A1319058 a similar machine is described wherein, in addition to such first gripping and tensioning means, second gripping and tensioning means is also provided for gripping the upper in the waist region thereof and tensioning it, heightwise of the shoe bottom in said region. The construction and arrangement of such second gripping and tensioning means is however disadvantageous in that said means is permanently located to either side of the shoe support, thereby restricting the operating locality and rendering the loading of the shoe more difficult. In accordance with the present invention, therefore, preferably first and second gripping and tensioning means are provided and furthermore the second gripping and tensioning means is mounted on the support arrangement for bodily movement heightwise between an operative position, in which said means can be caused to operate as aforesaid, and a retracted position. Thus, firstly by virtue of the second means being mounted on the support arrangement, it is moved to an out-of-the-way position when the support arrangement is in its spaced relationship with the shoe support, and secondly said means is bodily moved to a retracted position when its upward tensioning action is completed and the shoe is clamped by the heel band. In this way, the second means in no way interferes with the loading or other activities of the operator, while nevertheless removing the need for the operator to handle the shoe during the inward movement of the heel band.

Conveniently furthermore, means is provided for effecting bodily movement of the second gripping and tensioning means as aforesaid, said means also being effective to cause movement of the holddown between its operative and retracted positions. Furthermore, since the position of the second gripping and tensioning means relies upon its relationship with the holddown and, in the event that the holddown requires re-positioning said means should also be re-positioned, preferably there are provided in the machine in accordance with the invention first adjustment means for adjusting the operative position of the holddown together with that of the second gripping and tensioning means, and second adjustment means for adjusting the operative position of the second gripping and tensioning means relative to that of the holddown.

Moreover, as in the machine described in GB-A1319058, preferably the second gripping and tensioning means comprises two grippers arranged to lie one at either side of the shoe support when in operative position, each gripper comprising two jaws one of which is movable relative to the other to effect opening and closing of the gripper, and also having associated therewith an abutment engageable with the side of the shoe, for positioning the gripper widthwise of the shoe, and means being provided for effecting movement of each abutment and its associated gripper in a direction widthwise of the shoe. In the machine in accordance with the invention, however, preferably the abutment is mounted for movement with the movable jaw of the gripper such that when the gripper is closed the abutment is moved to an out-of-the-way position in which it lies outside the path of advancing movement of the heel band. By this arrangement, it will be appreciated, the abutment lies clear of the approaching heel band, while nevertheless the force applied by the grippers, which are of course above the level of the heel band, can be applied in a region which is engaged by the approaching heel band without any interference thereby taking place. Thus, the second gripping and tensioning means carries out an operation which is very similar to that previously carried out manually by the operator, but without risk of injury. Another advantage of the pivotal movement of the abutments is that they can also be moved to their out-of-the-way position as relative movement of approach takes place between the shoe support and the support arrangement; it will of course be borne in mind that such relative movement of approach takes place when a shoe has been loaded on to the shoe support, so that the abutments could otherwise foul on such shoe during the transverse movement of the support arrangement.

A machine is described in GB-A1152914 which is generally similar to the machine of US-A3138810 but in which adhesive-applying means is provided for applying adhesive to the heel seat of the shoe prior to the initiation of the inwiping movement of the wiper plates, said means comprising an imprinter nozzle mounted for movement between an operative position, in which it can engage the heel seat of a shoe supported by the shoe support, and a retracted position. It is desirable of course that such means does not require excessive flexing of its component parts, especially the flexible hoses and the like, and consequently in the machine in accordance with the invention conveniently said means is mounted on the support arrangement, thereby avoiding the need for any such excessive flexing. As in the machine of GB-A1152914, furthermore, the adhesive-applying means also comprises a melt chamber and a feed device for feeding adhesive in rod form to said chamber. In the machine in accordance with the invention, preferably the feed device comprises two feed wheels each having a rod-gripping surface, between which wheels the rod can be inserted and by which it is fed, a drive arrangement, including an n.c. motor, being provided for driving the wheels in accordance with a programmed instruction. By the term "n.c. motor" where used herein is to be understood a motor the operation of which is controlled by control signals supplied thereto in accordance with stored information appropriate to a desired operation. Examples of such motors are stepping motors and d.c. servomotors. Where such a feed device is used, furthermore, preferably the one feed wheel is supported on a lever for movement towards and away from the other wheel and the drive arrangement comprises, for said one feed wheel, a belt-and-pulley arrangement which is so arranged that an increase in the resistance of the rod to being fed causes a commensurate increase in the pressure applied to the rod by the two feed wheels by urging said one wheel towards the other under greater force.

In using the apparatus in accordance with the invention, clearly the operator still has to manipulate the upper in the early stages of loading, and more particularly has to ensure, once the first gripping and tensioning means has effected a lengthwise and heightwise pull on the shoe upper, that the upper is in the desired location on its last. Thereafter, however, preferably the operator should not be able to carry out further manipulations during the operation of the machine, but rather should ensure that his hands are well clear of the operating locality. To this end, therefore, in accordance with the present invention preferably a guard is provided which is moved to an operative position, in which it prevents access to the operating locality of the machine, prior to relative movement of approach taking place between the shoe support and the support arrangement. Moreover, where second (waist) gripping and tensioning means is provided as set out above, preferably the guard arrangement operates prior to the operation of said second gripping and tensioning means, thereby to ensure that the operator's hands are well clear of the operating locality as the heel band approaches. As in the case of the apparatus shown in US-A3138810, the present invention also provides a backpart moulding and heel seat lasting apparatus comprising two machines as set out above arranged side-by-side. Furthermore, in the apparatus in accordance with the invention, preferably the support arrangement of each of said machines is mounted for transverse movement relative to the shoe support in a direction towards the other machine, and furthermore said apparatus comprises a shoe-receiving device, disposed between the two machines for receiving a shoe from either of them when the support arrangement thereof is moved transversely as aforesaid. Said device may be constituted by the receptacle into which shoes can fall when released by the heel band as aforesaid, but other devices may be used in place thereof, e.g. a shoe transfer device as described in EP-A0128756. In order to avoid the risk of any collision between shoes being transferred as aforesaid to the shoe-receiving device, furthermore, where in each machine that the carriage of each support arrangement is returned to its advanced position and the band clamping means is operative to release the shoe when the support arrangement is moved transversely as aforesaid, control means is preferably provided which, where both support arrangements have been moved transversely as aforesaid, prevents the return of the carriage of one of said arrangements to its advanced position, if such movement of the carriage of the other arrangement has already been initiated.

BRIEF DESCRIPTION OF THE DRAWINGS

There now follows a detailed description, to be read with reference to the accompanying drawings, of one machine in accordance with the invention (and also an apparatus constituted by two such machines). It will of course be appreciated that this machine has been selected for description merely by way of non-limiting example of the invention.

In the accompanying drawings.

DESCRIPTION OF THE PREFERRED EMBODIMENT

For the backpart moulding and heel seat lasting of shoes an apparatus is provided which comprises two machines, each illustrative of the invention in its machine aspects, arranged side-by-side for operating one on left shoes and one on rights, there being provided on or adjacent the outer wall of each machine an activator unit (not shown) whereby the backpart of a shoe to be operated upon can be heated to activate the thermoplastic counter (stiffener) incorporated in the backpart of the shoe. One such activating unit is described in U.S. Patent Specification No. 4284874. The two machines are identical, except as will be hereinafter described, and only one will therefore now be described with reference to the accompanying drawings.

Figure 1:
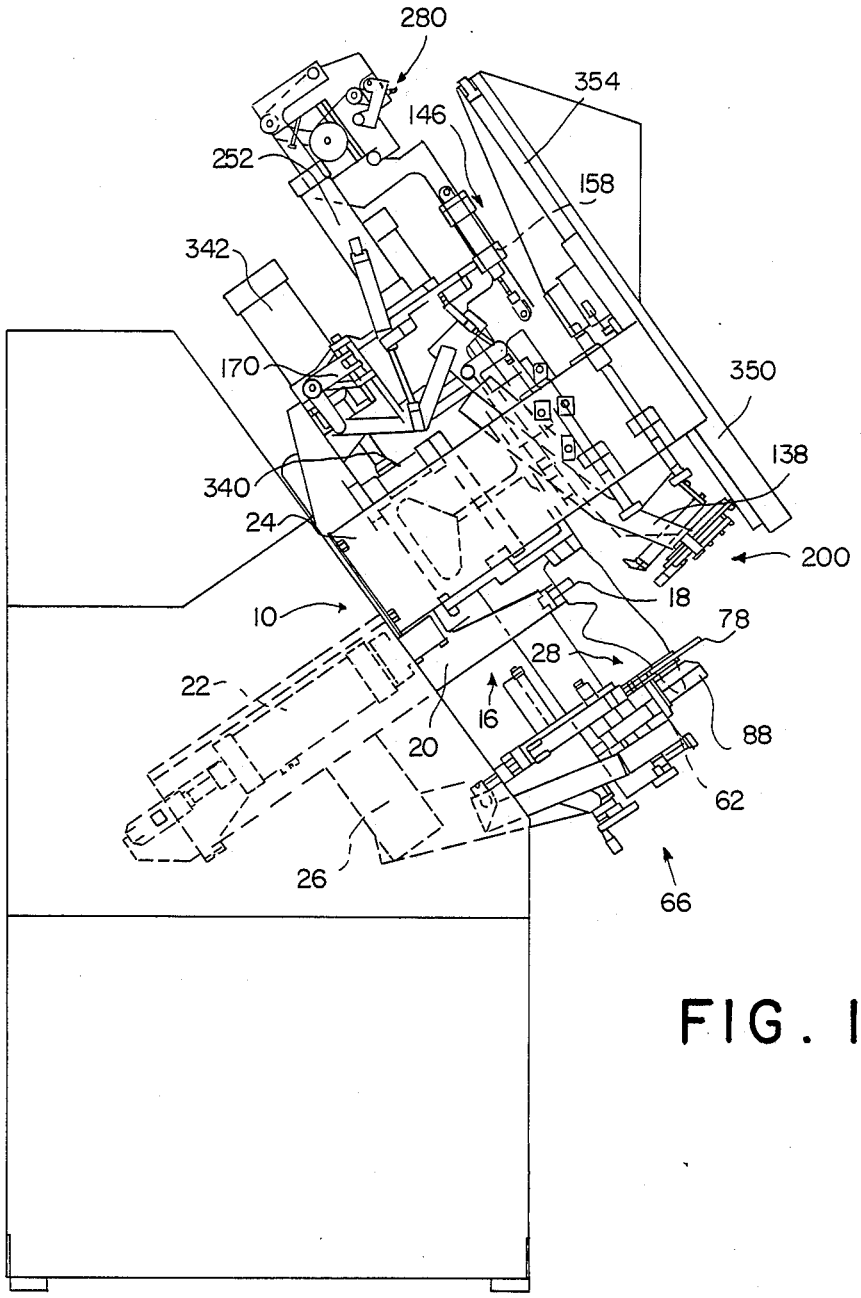
FIGS. 1 and 1A are views in side elevation of the machine in accordance with the invention.

The machine shown in FIG. 1 comprises a shoe support generally designated 10 which is so arranged that a shoe is supported thereby with the plane of its heel seat at an angle of 35° to the vertical away from the operator. The machine further comprises a wiper assembly generally designated 12 and a heel band assembly generally designated 14. More particularly, the shoe support 10 comprises a heel support generally designated 16, which itself comprises a last pin 18 mounted on a column 20 which is movable in a direction heightwise of the heel seat of a shoe supported thereby, by means of a piston-and-cylinder arrangement 22 supported on a frame portion 24 of the machine. Also mounted on the column 20 is a forwardly exending bracket 26 for supporting a toe support assembly generally designated 28, comprising a heightwise adjustable toe pad 62. Under the action of the piston-and-cyliner arrangement 22 the heel support, together with the toe support, is movable heightwise to bring the heel seat of a shoe supported thereby to a datum position (as will be hereinafter described) from a retracted position below said datum. The retracted position, which is determined by a proximity switch (not shown) on the column 20, constitutes a shoe loading position for the shoe support 10, there being a further retracted position, below said retracted position, to which the shoe support can be retracted by the action of the arrangement 22 (as will be referred to hereinafter).

The machine further comprises shoe upper gripping and tensioning means generally designated 66, including two gripper assemblies generally designated 88, one arranged at each side of the shoe support 10, by which lasting marginal portions of the forepart of the upper of a shoe supported by the shoe support can be gripped and the upper can then be tensioned, heightwise of the shoe bottom, by relative heightwise movement being effected between the gripper assemblies 88 and two so-called reaction levers 78, one cooperating with each of the gripper assemblies. In addition, the two gripper assemblies 88 are movable in a direction away from the heel seat of the shoe, thus to tension the shoe upper lengthwise of the last, under the action of a piston-and-cylinder arrangement (not shown).

Details of this shoe upper gripping and tensioning means 66 will be found set out in U.S. Patent Specification No. 4744120. It will however be appreciated that the gripping and tensioning of the upper as aforesaid takes place with the column 20 in its retracted position, for ease of loading the upper and adjusting its position on its last under the control of the operator, whereafter the column can be raised by the action of the piston-and-cylinder arrangement 22, thus to raise both the last pin 18 and the toe support assembly 28, together with the shoe upper gripping and tensioning means 66, heightwise in the machine, as aforesaid.

For determining the amount of heightwise movement the machine comprises a holddown 136 which is carried by a frame 138, itself mounted for pivotal movement on a support arrangement 170 (to be referred to hereinafter) to move the holddown 136 between an out-of-the-way position and an operative position, in which it can set the height of the heel seat of a shoe to be operated upon in accordance with the wiping plane determined by the wiper assembly 12. In FIG. 1 the shoe support 10 is illustrated in its loading position and the holddown 136 in its out-of-the-way position, the wiping plane being designated by the chain-dot line A.

Figure 1A:
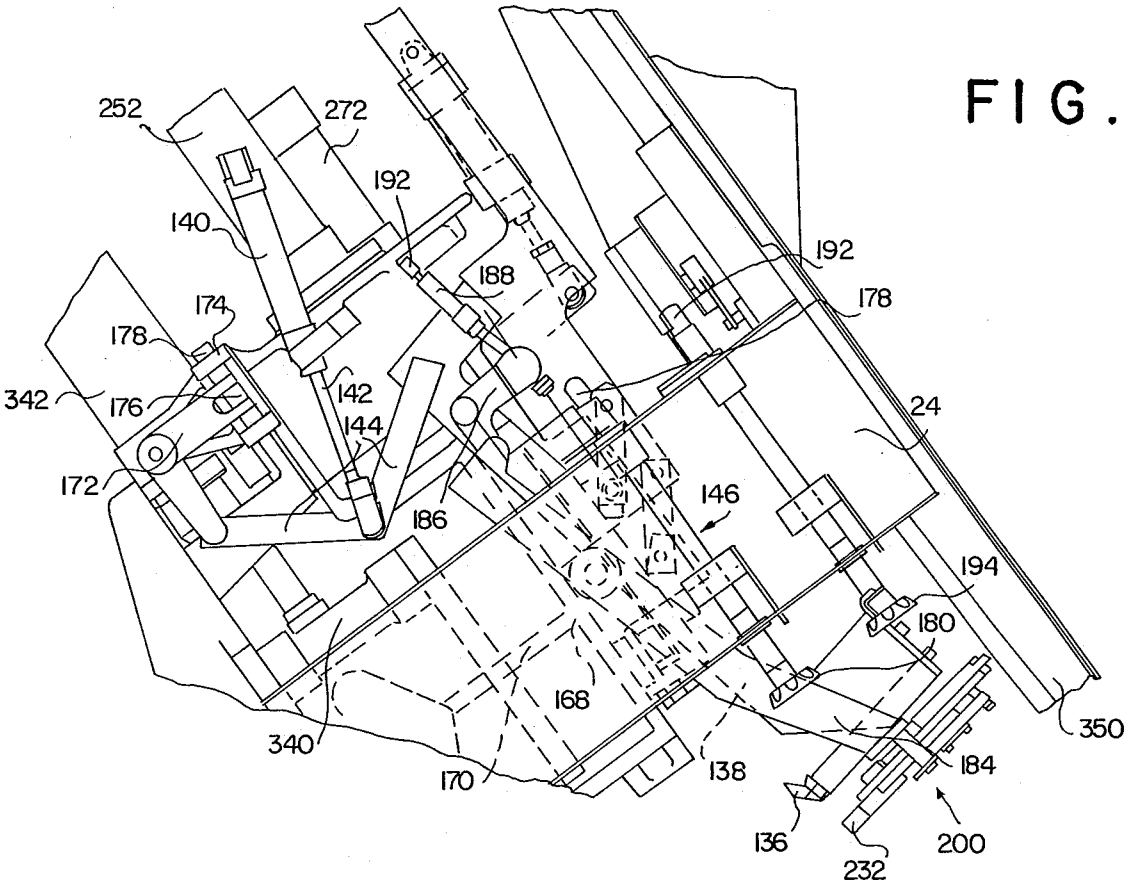

For effecting movement of the holddown as aforesaid, a piston-and-cylinder arrangement 140 (FIG. 1A) has a piston rod 142 which is operatively connected to the "elbow" of a toggle arrangement made up of two levers 144. The upper end of the upper lever 144 is pivotally connected to a rear portion of the frame 138 so that when the toggle arrangement is "made" or "broken" pivotal movement of the frame is caused to take place about a pivot 168 provided on the support arrangement 170. The lower end of the lower lever 144 is pivotally connected to one arm of a bell crank lever 172 which is pivotally carried by the support arrangement 170, the end of the other arm of said lever 172 being received in a bifurcated bracket 174 secured to the support arrangement and supporting a threaded rod 176 captive therein, said rod being threadedly connected to said end of the other arm of the bell crank lever. For rotating the threaded rod, and thus varying the position of the bell crank lever 172 in relation to the bracket 174, a flexible drive shaft 178 is provided, connected to the threaded rod 176 at one end and to a manually rotatable knob 180 at the other, said knob being arranged at the front of the machine. By varying the position of the bell crank lever 172, it will be appreciated, the heightwise position of the toggle arrangement 144 is similarly varied so that, when the toggle is "made" by the retraction of piston rod 142 into its cylinder, the lowermost, operative, position of the holddown is similarly adjusted.

The machine in accordance with the invention also comprises waist gripping and tensioning means generally designated 200 by which the lasting marginal portions of the upper of a shoe supported by the shoe support 10 can be gripped in the waist region thereof and tensioned heightwise of the shoe bottom. Said means 200 is mounted on an auxiliary frame 184 which is also mounted for pivotal movement about the pivot 168 upon operation of piston-and-cylinder arrangement 140. To this end, the auxiliary frame 184 is pivotally connected to one arm of a bell crank lever 186 itself pivotally mounted on the frame 138. The upper end of the other end of the bell crank lever 186 pivotally supports a trunnion block (not shown) in which is threadedly engaged a threaded rod 188 which is captive in, and projects from, an upstanding bracket portion formed integral with the frame 138, said rod being further connected, by a flexible drive shaft 192, to a further manually rotatable knob 194 disposed at the front of the machine. By rotation of the knob 194, therefore, the position of the bell crank lever 186 on the frame 138 can be adjusted, thereby adjusting the relative positions of the frame 138 and auxiliary frame 184 and further thus adjusting the heightwise position of the waist gripping and tensioning means 200. In this manner, said means 200 can be adjusted heightwise relative to the holddown 136, while nevertheless being movable heightwise towards and away from the bottom of a shoe supported by the shoe support 10 in unison with the holddown.

Figure 3:
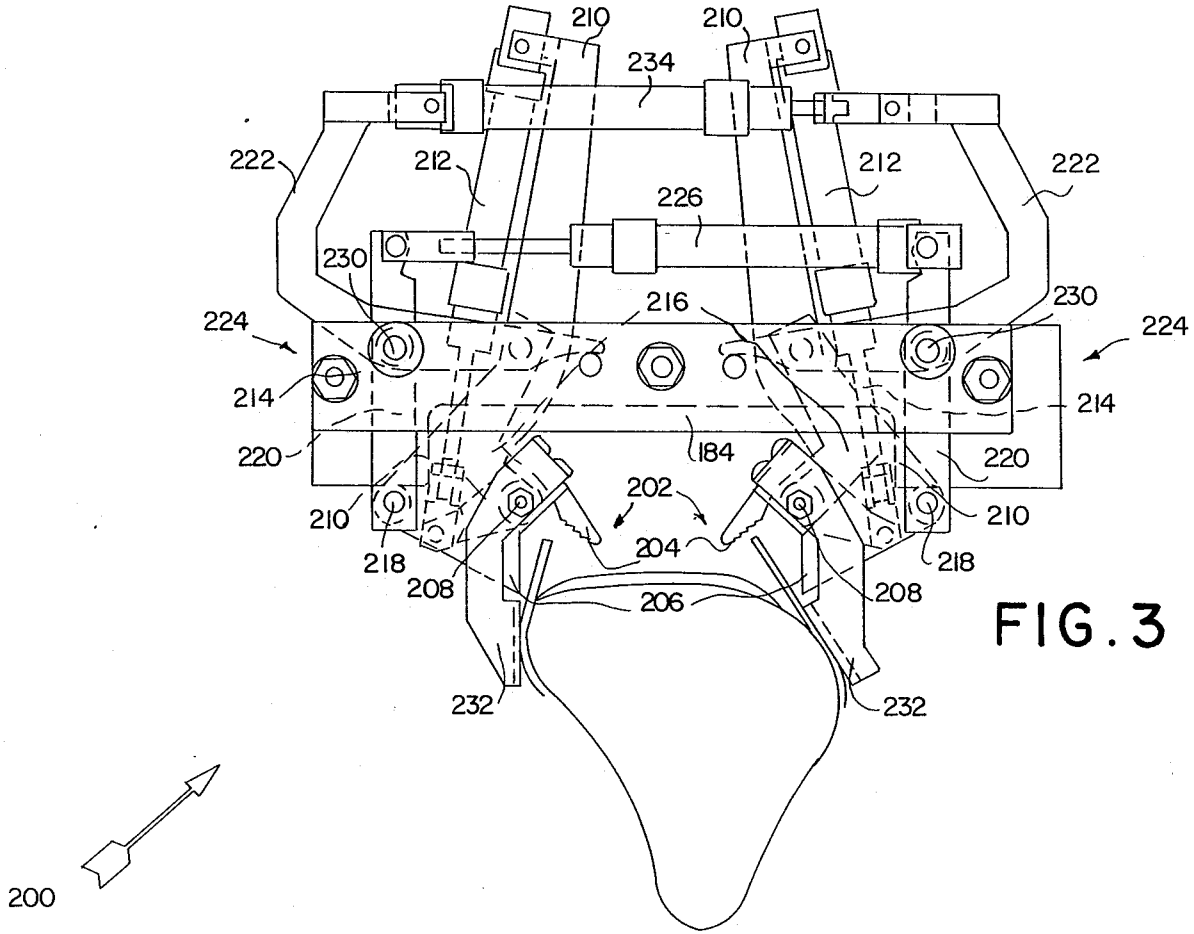
FIG. 3 is a front view of waist gripping and tensioning means of the machine.

The waist gripping and tensioning means 200, which is described in greater detail in now abandoned U.S. patent application Ser. No. 320,168 in the name of K. J. Tutt and of even date with this Application, comprises two grippers generally designated 202 arranged one at either side of the shoe support 10 when in operative position. The two grippers 202 are essentially mirror-opposites of one another and only one will now be described with reference to FIG. 3. The gripper 202 comprises two jaws 204, 206, one (204) of which is mounted for pivotal movement about a pivot 208 on the other (206), thus to open and close the gripper. (The jaw 204 will be hereinafter referred to as the "movable jaw", and the jaw 206 as the "fixed jaw".) The pivot 208 is carried towards a lower end of a lever 210 with which the fixed jaw 206 is formed integral. The lever 210, which extends heightwise, carries a piston-and-cylinder arrangement 212, a piston rod 214 of which is connected to the movable jaw 204, for opening and closing the gripper. The lever 210 is itself supported on the pivot 208 by a cranked link 216 and further, at a pivot 218, by a second link 220, the two links 216, 220 being in turn pivotally connected, spaced apart, to a lever 222 which is generally swan-necked in shape. The lever 222, links 218, 220 and the portion of the lever 210 between said links thus constitute a parallel linkage arrangement generally designated 224.

Utilising the parallel linkage arrangement 224 the two grippers 202 may be moved firstly inwardly towards one another by the action of a piston-and-cylinder arrangement 226, of which the cylinder is pivotally supported on an upper extension of the link 220 of the right-hand gripper (viewing FIG. 3) and the piston rod 228 on an upper extension of the link 220 of the left-hand gripper. When the piston rod is retracted into its cylinder, the lower ends of the links 220 are pivoted outwardly about a pivot 230, which is fixed in the auxiliary frame 184, thereby, through the parallel linkage arrangement 224, withdrawing the two grippers 202, in a generally horizontal direction, away from the shoe. Conversely, upon extension of the piston rod 228, the two grippers are moved inwardly towards the shoe.

For limiting the inward movement of each gripper, an abutment is formed integral with the movable jaw 204 such that when the jaw is in 'opened' condition the abutment 232 extends downwardly and when the jaw is 'closed' the abutment is moved out of the way. In operation after the frame 138 and auxiliary frame 184 have been lowered to their operative position with the grippers open, the abutments will engage the "high wood" of the shoe when moved inwardly, thus to position the grippers, more particularly the fixed jaws 206, so that they lie adjacent the upstanding lasting marginal portions of the shoe, which upon pivoting the movable jaws, can thus be gripped by the grippers. In order that, in pivoting the movable jaws to close the grippers, and thus pivoting the abutments 232 to an out-of-the-way position, further inward movement is thereby not occasioned by the operation of piston-and-cylinder arrangment 226, the supply of fluid under pressure to said arrangement is discontinued prior to operation of piston-and-cylinder arrangements 212 to close the grippers.

The grippers 202 are also able to be drawn heightwise of the shoe bottom in order to tension the thus gripped upper about its last, and to this end the upper ends of the swan-necked levers 222 are similarly connected one with the cylinder of a piston-and-cylinder arrangement 234 and the other with the piston rod thereof, thus to cause the levers to be pivoted about the pivot 230. Whereas in the operation of piston-and-cylinder arrangement 226 the levers 222 remained stationary and the links 220 were pivoted, in this case the links 220 are held stationary by the arrangement 226 and the levers 222 pivot whereby, through the parallel linkage arrangements 224, the levers 210 are caused to be drawn upwardly, thus to effect upward tensioning of the shoe upper.

Figure 2:
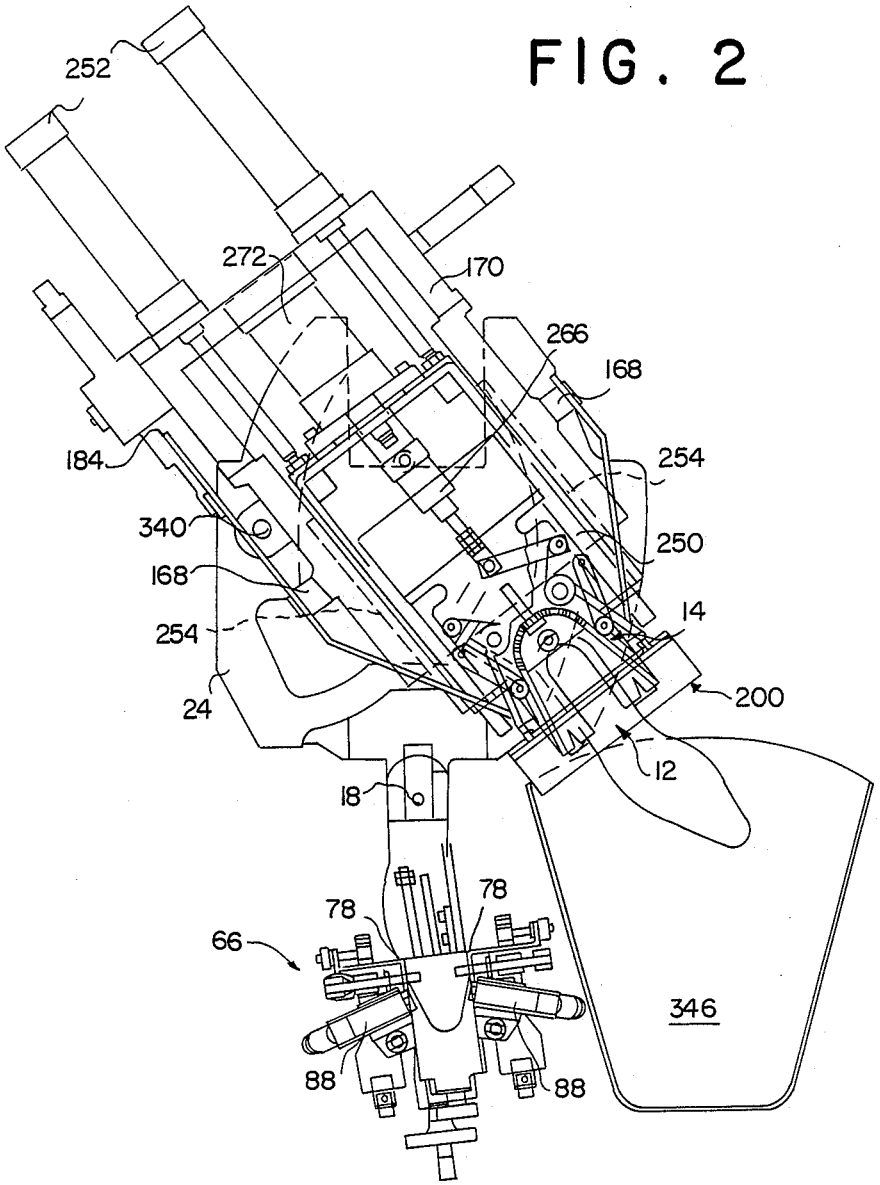
FIGS. 2 and 2A are plan views of the operating locality of the machine, showing a guard arrangement thereat and details of a support arrangement of said machine.
Figure 2A:
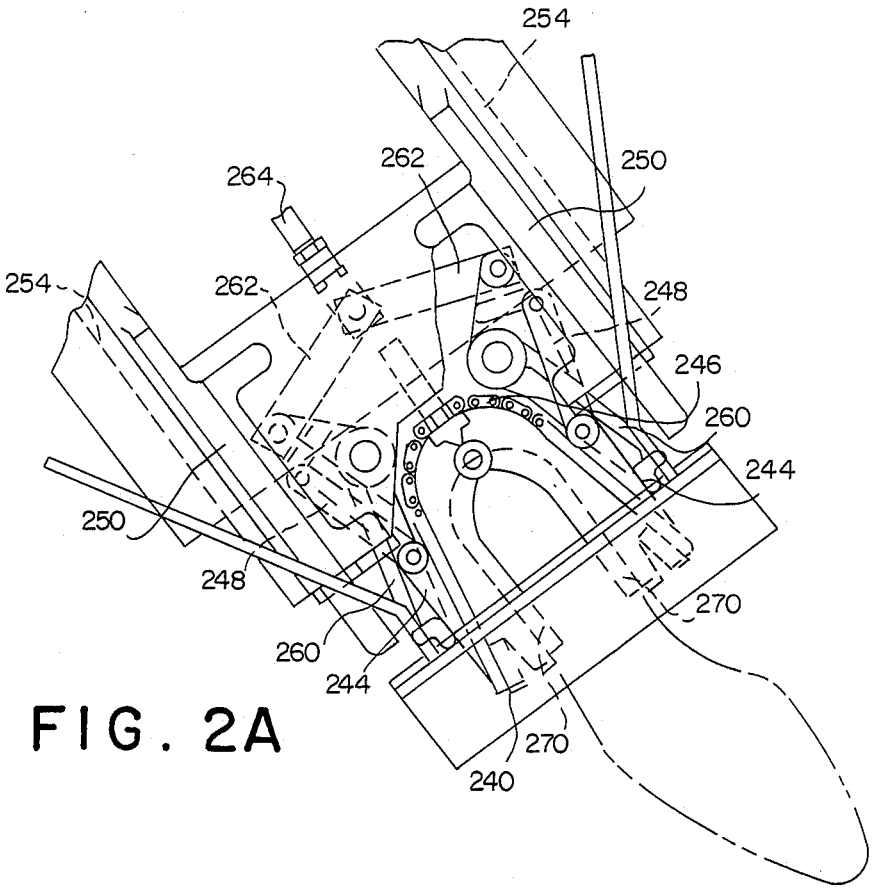

The heel band assembly 14 of the machine is also supported by the support arrangement 170 for movement fore-and-aft of the machine. Said arrangement comprises a heel band 240 (FIG. 2A) having a shoe-engaging surface which affords a contour complementary to the backpart of the shoe being operated upon, whereby the heel band not only can clamp the shoe securely, but also conforms closely to the shape of the backpart thus to effect a moulding operation thereon. More particularly, the heel band 240 can be "clipped" into a holder therefor comprising a spring steel band 242 opposite ends of which are secured each to a lug portion 244, said lug portions being connected, around the backpart region of the band 242, by a chain 246. Each lug portion 244 is pivotally mounted on a link 248 supported by a carriage 250 which is movable fore-and-aft of the machine under the action of two piston-and-cylinder arrangements 252 (FIG. 2) mounted on the support arrangement 170. The support arrangement also provides slide guides 254 for the carriage 250. The carriage 250 is thus movable towards and away from the shoe support 10 into and out of an operative position in which a heel band 240 supported thereby as aforesaid engages the heel end of a shoe supported by the shoe support, the arrangement being such that the backseam region of the band first engages the shoe and continued movement thereafter causes the heel band to "wrap" around the shoe against the opening influence of the spring steel band 242.

The heel band assembly 14 also comprises heel band clamping means in the form of two bell crank levers 260 (FIG. 2A) pivotally mounted on the carriage 250, one arm of each lever being arranged to engage a lug portion 244 and the other arm being connected, by a link 262, to a piston rod 264 of a piston-and-cylinder arrangement 266 (FIG. 2) also mounted on the carriage. Actuation of the arrangement 266 causes the bell crank levers 260 to pivot thus to press said first-mentioned arms thereof against the lug portions and thus to clamp the "legs" of the heel band 240 against the shoe.

The wiper assembly 12 of the machine is also supported in the carriage 250 for bodily sliding movement fore-and-aft of the machine to the position determined by the engagement of the heel band with the heel end of a shoe. The wiper assembly is of conventional construction and comprises a pair of wiper plates 270 (FIG. 2A) which are caused to effect a forward and inward in-wiping movement, relative to the heel band, over the heel seat of a shoe supported by the shoe support under the action of a piston-and-cylinder arrangement 272 (FIG. 2A) mounted on the carriage and acting through a cam arrangement (not shown, but of conventional construction).

Figure 4:
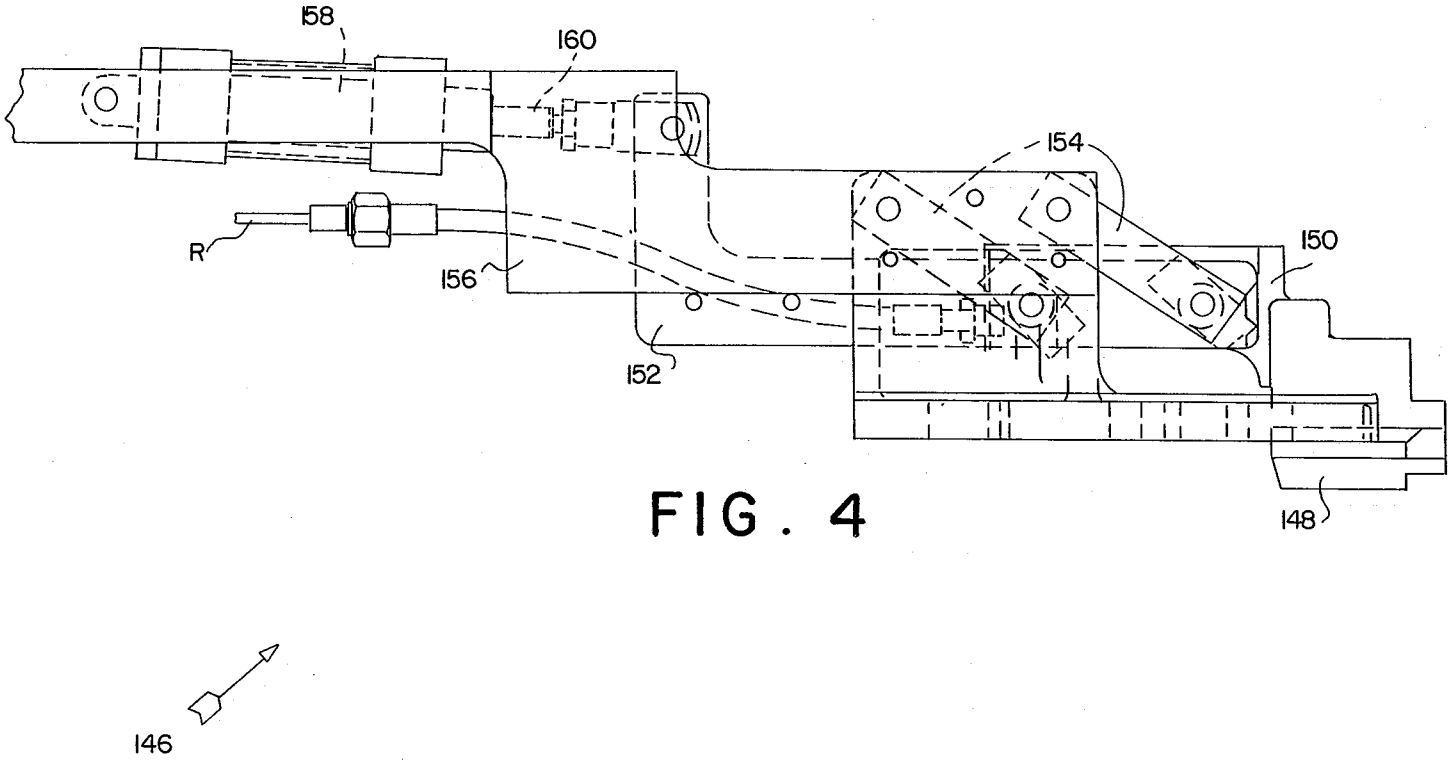
FIG. 4 is a side view showing details of adhesive-applying means of said machine.

Also mounted on the carriage 250 is adhesive-applying means generally designated 146 (FIGS. 1A and 4), said means comprises a generally U-shaped nozzle plate 148 (FIG. 4) having in its under-surface a row of outlets for adhesive. The outlets are connected through the plate to a melt chamber 150, said plate and chamber both being mounted on a carrier plate 152 supported by two pairs of parallel links 154 on a sub-frame 156 itself supported by the carriage 250. The sub-frame 156 supports a piston-and-cylinder arrangement 158 a piston rod 160 of which is connected to the carrier plate 152, extension of said piston rod being effective, through the parallel links 154, to move the nozzle plate 148 in a direction up and away from the bottom of a shoe supported by the shoe support, and retraction of the piston rod into the cylinder being effective to move the nozzle plate downwards and in a direction rearwardly of the machine into engagement with the heel seat of a shoe supported by the shoe support.

Figure 5:
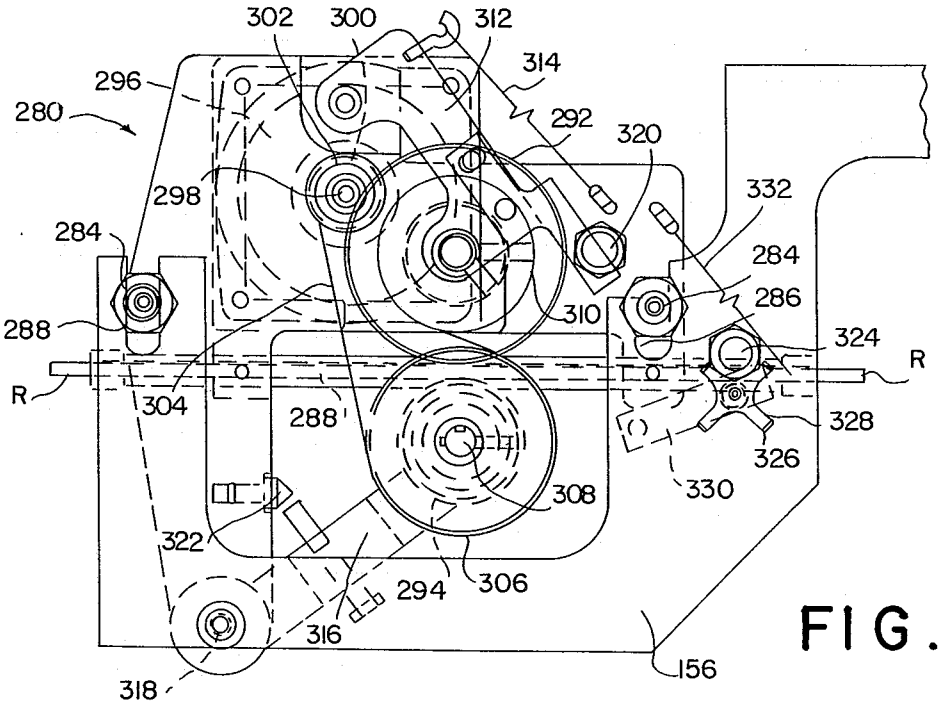
FIG. 5 shows, on an enlarged scale, a rod feed device of the adhesive-applying means of FIG. 4.

The melt chamber 150 is supplied with adhesive in rod form R by means of a rod feed device generally designated 280 (FIG. 5), the arrangement being such that the outflow from the outlets of the nozzle plate 148 is dependent upon and controlled by the infeed of the rod R into the melt chamber 150. The rod feed device comprises a mounting frame 282 which is removably supported by spigot pins 284 in four open slots 286 formed in a rearward extension of the sub-frame 156. The mounting frame supports a tubular rod guide 288 through which the rod R can be fed and from which it passes along a flexible tubing 290 to an inlet of the melt chamber 150. The guide 288 has a cut-away portion for the purpose of engaging the rod R by two feed wheels 292, 294. Each feed wheel has a rod-gripping surface, e.g. a toothed surface, so as to be able to feed the rod without slipping. (For reasons to be later explained, the surface of the feed wheel 292 is in any event toothed.)

For driving the feed wheels drive means comprising a reversible stepping motor 296 is mounted on the mounting frame 282 and has an output drive shaft 298 on which are mounted a gear wheel 300 and a timing belt pulley 302. The gear wheel 300 meshes with the feed wheel 292 so as to drive it directly, while the pulley 302 is operatively connected by a timing belt 304 to a further pulley 306 which is mounted on a stub shaft 308 on which the feed wheel 294 is secured. For compensating for any "slack" in the timing belt, an idler pulley 310 is also provided, mounted on a lever 312 itself pivotally mounted on the mounting frame 282 and urged by a spring 314 so as to urge the idler pulley into engagement with the belt.

The stub shaft 308 is carried by a lever 316 which is pivotally mounted on the mounting frame 282, such that the feed wheel 294 is movable towards and away from the cut-away portion of the rod guide 288; more particularly, the timing belt 304 serves to urge the feed wheel 294 into engagement with a rod R within the guide, the applied force under "normal" condition being thus determined by the spring 314. Where, however, there is resistance to the rod R being fed, the tension in the timing belt 304 between the pulleys 302, 306, in a direction "upstream" of the pulley 302, is increased, thereby serving to urge the feed wheel 294 under a greater force towards the cut-away portion by drawing the pulley 306 theretowards, the applied force being thus dependent upon the tension in the belt. Furthermore, the pivot 318 of the lever 316 is so positioned that, as the pulley is so drawn, the feed wheel 294 is urged towards the rod guide with a component of movement in a direction opposite to that of the direction of rod feed, thereby enhancing the gripping effect of the feed wheel. It will be noted that the axis of the feed wheel 292 is fixed in the mounting frame 282.

The rod feed device 280 also comprises sensing means in the form of a proximity switch 320 which cooperates with the lever 312 by which the idler pulley 310 is supported, the arrangement being such that if the idler pulley is moved through a sufficient distance towards the timing belt, the proximity switch is actuated to cause the operation of the stepping motor 296 to be terminated. Such movement of the idler pulley is likely to be occasioned when for example the end of a rod R of adhesive has passed through the cut-away portion of the rod guide, without a new rod having been introduced, so that the feed wheel 294 is drawn further inwardly towards the rod guide, thereby causing the further inward movement of the idler pulley to maintain the tension in the belt. A stop 322 is provided for preventing such an amount of movement of the feed wheel 294 towards the rod guide that the wheel contacts the rod guide.

The rod feed device 280 also comprises further sensing means constituted by a further proximity switch 324, arranged "downstream" of the cut-away portion of the rod guide and cooperating with a multi-arm vane 326 which is mounted for rotation with a small gear wheel 328 carried by a lever 330 mounted in the mounting frame 282. Spring 332 is provided for urging the gear wheel 328 towards the rod guide. The gear wheel 328 projects into a further cut-away portion of the rod guide and is driven by the rod R as it passes said further cut-away portion. When the rod is being fed normally, the vane 326 rotates and thus, in cooperation with the proximity switch 324 creates a signal in the form of a series of pulses. If, however, the rod feed is intermittent or discontinued, a different signal is thus created by the vane in cooperation with the proximity switch, which is an indication that adhesive is not being fed as required.

From the foregoing it will be apparent that the carriage 250 supports the wiper assembly 12, the heel band assembly 14, the holddown 136, the waist gripping and tensioning means 200 and the adhesive-applying means 146, the carriage being slidable into and out of an operative position, determined by the engagement of the heel band 240 with the heel end of a shoe supported by the shoe support 10, by means of the piston-and-cylinder arrangements 252. In addition, however, in order to move the now retracted carriage 250, together with the various instrumentalities supported thereby, to a more remote position, the support arrangement 170 is itself mounted for pivotal movement about an axis 340 (FIGS. 1, 1A and 2) extending heightwise of the bottom of a shoe supported by the shoe support. To this end, a piston-and-cylinder arrangement 342 is provided, mounted on the frame portion 24 of the machine and having a piston rod pivotally connected to the underside of the support arrangement 170. The arrangement of the axis 340 in each of the machines forming part of the apparatus in accordance with the invention is so arranged that the support arrangement 170 swings inwardly, i.e. towards the other machine, under the action of piston-and-cylinder arrangement 342. The amount of such movement furthermore is determined by the stroke of the arrangement 342 and is so set that, when either support arrangement 170 has been so swung about the axis 340, the heel band assembly 14 lies substantially above a receptacle 346 for shoes, which is disposed substantially centrally between the two machines, and into which a shoe retained by the heel band assembly 14 (as hereinafter described) can be dropped upon release by the heel band.

The machine in accordance with the invention also comprises electronic control means, including a microprocessor (not shown) by which various functions of the machine can be controlled, including temperature control of the melt chamber 150 and general "supervision" of the functions of various solenoid valves by which the sequence of operations of the machine is controlled. In addition, the microprocessor can be programmed to control the operation of the stepping motor 296, and thus to control the amount of adhesive rod R being advanced to the melt chamber 150. Said means can thus control the amount of adhesive supplied to the nozzle plate 148 in a cycle of operation of the machine and, in response to signals from either one of the proximity switches 320, 324 of the adhesive-applying means can monitor the supply of adhesive to the nozzle plate.

In a cycle of operation of the machine, the operator first loads a shoe, comprising an upper loose on a shoe last and with an insole on the last bottom, on to the last pin 18. At this stage, the support arrangement 170 is pivoted to an out-of-the-way position, and the carriage 250 is retracted within the support frame. The operator, in thus loading the shoe, ensures that the lasting marginal portions of the upper, in the region of the forepart of the shoe, will be gripped by the gripper assemblies 88. Thereupon, by actuation of a suitable operator-actuatable switch, e.g. a foot switch, the grippers are closed and the upper is gripped and tensioned both heightwise and lengthwise of the shoe bottom thus to wrap the backpart of the upper about the heel end of the last. At this stage, the operator may vary the position of the upper on its last, in particular the location of the back seam in relation to the last.

When the operator is satisfied with the position of the upper, further actuation of the operator-actuatable switch initiates a sequence of operations. For protecting the operator from danger during the operating cycle, a guard 350 (FIG. 1) is provided, which is slidable in guides 352 mounted on the frame portion 24 of the machine and movable from an out-of-the-way position, in which the operator is afforded access to load a shoe as aforesaid, and an operative position, in which the operating locality of the machine is shielded from access by the operator. Such movement of the guard 350 is effected by a piston-and-cylinder arrangement mounted on the frame portion 24 of the machine.

Thus, upon the second actuation of the operator-actuatable switch, the guard 350 moves into its operative position and thereafter piston-and-cylinder arrangement 342 is actuated to swing the support arrangement 170 about the axis 340 to a position in which the operating instrumentalities supported by the carriage 250 in the support arrangement 170 are aligned with the shoe support 10. During this in-swinging movement, furthermore, the grippers 202 of the waist gripping and tensioning means 200 are closed, so that the abutments 232 thereof are held in an out-of-the-way position by the piston-and-cylinder arrangements 212.

With the support arrangement in its aligned position, firstly the movable jaws 204 of said grippers 202 are opened, thereby pivoting the abutments 232 to an operative position, and thereafter the frame 138 is moved downwardly about its pivot 168 to bring the holddown 136 into its datum position. The column 20 of the shoe support 10 can then be raised by the action of the piston-and-cylinder arrangement 22, to bring the heel seat of the shoe into engagement with the holddown, and thus to set the height of the heel seat of the shoe in relation to the plane of the wiper plates 270.

With the shoe thus positioned, the grippers 202, now in open condition, are moved inwardly under the action of piston-and-cylinder arrangement 226 until the abutments 232 engage the sides of the shoe, in the region of the "high wood" thereof, thus setting the transverse position of the grippers 202. With the grippers so positioned, the supply of fluid under pressure to said arrangement 226 is discontinued and thereafter, by the action of piston-and-cylinder arrangements 212, the movable jaws 204 close onto the lasting marginal portions of the shoe upper, in the waist region thereof. With the upper thus gripped, furthermore, piston-and-cylinder arrangement 236 is then actuated to cause the grippers 202 to be moved upwardly relative to the shoe bottom, thus to tension the upper heightwise of the shoe in the waist region thereof.

The sequencing of these various operations is under the control of the microprocessor.

At this stage the lasting marginal portions of the shoe, in the heel seat region thereof, are maintained by the waist gripping and tensioning means 200 in an upstanding condition, and in this condition the adhesive-applying means 146 is operated to bring the nozzle plate 148 downwardly into engagement with the heel seat of the shoe. Furthermore, by operation of the rod feed device 280, a predetermined quantity of rod R is fed into the melt chamber, with a commensurate outflow of adhesive from the melt chamber to the nozzle plate 148, whereby a predetermined quantity of molten adhesive is applied through the nozzle plate to the shoe bottom. At the end of the cementing operation, furthermore, piston-and-cylinder arrangement 158 is actuated to return the nozzle plate 148 upwardly and away to its out-of-the-way position. In addition, if desired, at this stage the motor 296 may be driven in a reverse direction through a short distance, thus to cause the adhesive in the system to be "sucked" back, thus to avoid drooling of adhesive from the nozzle plate 148 during the following lasting operation.

The carriage 250 is then caused to move forwardly, under the action of piston-and-cylinder arrangements 252, to an operative position, as determined by the engagement of the heel band 240 with the heel end of the shoe. Such engagement also causes the heel band 240 to wrap around the heel end of the shoe, under the force applied by said arrangements 252, whereby the backpart of the shoe, which may contain a previously activated thermoplastic stiffener (counter), can be clamped snugly to the shape of the last by the complementarily shaped heel band. Additional clamping pressure is then applied through the links 262 under the action of piston-and-cylinder arrangement 266. It will be appreciated that no risk of collision between the advancing heel band 240 and the abutments 232 forming part of the waist gripping and tensioning means 200 arises at this time because the movable jaws 204 of said grippers are closed and thus the abutments are in their out-of-the-way position. By this arrangement, it will be appreciated, the grippers 202 can be located much more closely to the breast line region of the shoe than would otherwise be the case.

With the backpart of the shoe thus clamped, piston-and-cylinder arrangements 212 are de-actuated thereby releasing the grip of the grippers, which are then raised by the continued action of piston-and-cylinder arrangement 236. The wiper assembly 12 is then actuated, the wiper plates 270 being caused to move forwardly and inwardly, by means of piston-and-cylinder arrangement 272, thus to wipe marginal portions of the shoe upper, in the heel seat region thereof, over and press them against corresponding marginal portions of the insole, the marginal portions thus being bonded together by the applied adhesive. With the wiper plates in this position, furthermore, the holddown 136 is retracted, by retraction of the frame 138 which also causes the waist gripping and tensioning means 200 to be retracted, and a bedding pressure is applied, through piston-and-cylinder arrangement 22, to the heel seat of the shoe supported by the shoe support 10. At this stage also the grippers 202, no longer gripping the upper, are closed thus to move the abutments 232 to their out-of-the-way positions.

Because the machine in accordance with the invention has the combined function of moulding the backpart of the shoe and also lasting the heel seat thereof, two distinct time periods are required to be determined, namely a "moulding time", which begins when the heel band 240 is clamped about the backpart of the shoe and the duration of which is determined according to the mouldability of the stiffener, and a "bedding time" which begins with the application of heavy pressure to the shoe support and the duration of which is dependent upon the consolidation of the bond. The machine thus comprises first timer means (not shown but identified as T1 for ease of reference) for setting the moulding time, and second timer means (also not shown but identified as T2) for setting the bedding time. When timer T2 times out the column 20 is caused to be retracted to its further retracted position, thus to withdraw the last pin from the last, under the action of piston-and-cylinder arrangement 22, while the heel band 240 is still in clamping engagement with the backpart of the shoe and the wipers are still in their forward and inward condition. Furthermore, to facilitate the withdrawal of the last pin 18, the pressure applied by piston-and-cylinder arrangements 252 at this stage, urging the heel band against the shoe is balanced. With the last pin removed, the carriage 250 is then retracted into the support arrangement 170 by the operation of piston-and-cylinder arrangements 252, while nevertheless the shoe remains clamped and the wipers remain over the shoe bottom. At this stage, furthermore, the support arrangement 170 is then swung to its position shown in FIG. 2, by the action of piston-and-cylinder arrangement 342, in which position the shoe is now held above the receptacle 346. Also at this stage, the guard 350 is retracted, thereby allowing access by the operator to the operating locality, and also the shoe support can be returned to its retracted position as determined by the proximity switch. The operator can then load a further shoe which can then be tensioned on its last by means of the gripping means 88, while the application of moulding pressure to the treated shoe is continued. When the timer T1 times out, the carriage 250 is again moved forwardly relative to the support arrangement 170, the wiper plates 270 are retracted and the clamping of the heel band against the shoe, under the action of piston-and-cylinder arrangement 266, is relieved, whereupon the shoe falls into the receptacle 346. The carriage 250 can then be retracted in readiness for the next cycle of operation.

It will be appreciated that, since the moulding time begins at an earlier point in the operating cycle than the bedding time, it may be that, when the operator sets these times, the "moulding" timer T1 times out before the "bedding" timer T2. The electronic control means, however, is so organised that the shoe cannot be released until the support arrangement 170 has been swung to its position over the receptacle 346 and the various operations described above have been effected.

In an alternative embodiment of the invention timer means may be provided which is actuated in response to the retraction of the last pin 18 and, upon timing out, causes the heel band to release the shoe and the wiper plates to be retracted as described above, the support arrangement 170 having been swung about its pivot 340 following retraction of the last pin. Moreover, in said alternative embodiment the actuation of said timer means is effected in response to the timing out of further timer means in response to which also the retraction of the last pin is initiated, said further timer means being actuated when the heel band 240 is clamped about the backpart of the shoe.

When using the machine for operating on high-legged boots, it will be appreciated, the retraction of the last pin 18 from the last will still not serve to clear the shoe support from the boot, so that it is not possible in such a case for the boot to be transferred over the receptacle 346, but rather must remain in the operating locality to be removed therefrom. The machine therefore is also provided with a selector switch (not shown, but identified as SS1 for ease of reference) by which the operator can select the timing of the heightwise movement of the last pin 18; more particularly, for operating upon shoes a cycle can be selected as above described, while for operating upon boots a cycle can be selected wherein the heel band 240 is released from the clamping pressure applied by piston-and-cylinder arrangement 266, the wiper plates 270 are retracted and also the carriage 250 is retracted prior to the swinging of the support arrangement 170 to its out-of-the-way position. Furthermore, when a 'boot' cycle of operation is selected using selector switch SS1, the electronic control means is so organised that, if timer T1 times out before timer T2, the moulding pressure is nevertheless maintained until timer T2 has timed out.

The relationship between the support arrangements 170 of the two side-by-side machines is such that it is not possible for both to be located above the receptacle 346 with their respective carriages 250 in the advanced position. Thus, the electronic control means is organised such that when one of the carriages 250 is signalled to move forwards as above described, with its support arrangement in said position over the receptacle 346, a signal is supplied to the electronic control means of the other machine to delay a similar signal being supplied to the carriage 250 of that machine, until the first-mentioned carriage is retracted. In this way, the risk of collision between two shoes which have been operated upon is avoided.

I claim:

1. A backpart moulding and heel seat lasting machine comprising a shoe support for supporting, bottom uppermost, a shoe comprising a shoe upper on a last and an insole on the last bottom, said support comprising a last pin which is received in a last pin hole formed in the crown of the last, a holddown, by which the heightwise position of the heel seat of a shoe supported by the shoe support is determined, the shoe support also comprising means for moving the last pin heightwise into and out of an operative position determined by the engagement of the heel seat of said shoe with the holddown, a heel band assembly, comprising a heel band which provides a moulding surface shaped complementarily to the heel end of the shoe to be operated upon and by which said heel end can be clamped and moulded, and a wiper assembly, comprising a pair of wiper plates and means for effecting forward and inward movement thereof whereby the wiper plates are effective to cause heel seat lasting marginal portions of the upper of a shoe the heel end of which has been clamped as aforesaid to be wiped over and pressed against corresponding marginal portions of the insole of said shoe whereby, with adhesive applied therebetween, said marginal portions are bonded together, said means also being effective to cause the wiper plates to be retracted at the end of their operation, and the arrangement being such that, with the wiper plates in an inwiped position, the holddown is retracted and increased pressure is applied to the shoe support thus to apply a bedding pressure to said marginal portions, wherein the heel band assembly and the wiper assembly are supported by a support arrangement, means being provided for effecting relative movement of approach between the shoe support and said support arrangement, to cause the heel end of a shoe supported by the shoe support to be engaged by the heel band, thus determining an operative relationship between the shoe support and the support arrangement, and for effecting relative movement of separation therebetween to a spaced relationship to facilitate the loading of a shoe on the shoe support, and further wherein the means for effecting heightwise movement of the last pin as aforesaid is effective to move the last pin in a direction away from the wiper plates out of its operative position prior to relative movement of separation being initiated between the shoe support and the support arrangement.

2. A machine according to claim 1 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, in said region, and wherein the second gripping and tensioning means is mounted on the support arrangement for bodily movement heightwise between an operative position, in which said means can be caused to operate as aforesaid, and a retracted position.

3. A machine according to claim 2 wherein the second gripping and tensioning means comprises two grippers arranged to lie one at either side of the shoe support when in operative position, each gripper comprising two jaws one of which is movable relative to the other to effect opening and closing of the gripper, and means for effecting movement of the grippers in a direction widthwise of the shoe, and wherein each movable jaw has an abutment mounted for movement therewith and engageable with the side of the shoe for positioning the gripper widthwise of the shoe, the arrangement being such that when the gripper is closed the abutment is moved to an out-of-the-way position in which it lies outside the path of advancing movement of the heel band.

4. A machine according to claim 1 wherein adhesive-applying means is mounted on the support arrangement for applying adhesive to the heel seat of the shoe prior to the initiation of the inwiping movement of the wiper plates, said means comprising an imprinter nozzle mounted for movement between an operative position, in which it can engage the heel seat of a shoe supported by the shoe support, and a retracted position.

5. A machine according to claim 4 wherein the adhesive-applying means also comprises a melt chamber, and a feed device for feeding adhesive in rod form to said chamber, said device comprising two feed wheels each having a rod-gripping surface, between which wheels the rod can be inserted and by which it is fed, and a drive arrangement, including an n.c. motor, for driving the wheels in accordance with a programmed instruction.

6. A machine according to claim 5 wherein the one feed wheel is supported on a lever for movement towards and away from the other wheel, and the drive arrangement comprises, for said one feed wheel, a belt-and-pulley arrangement which is so arranged that in increase in the resistance of the rod to being fed causes a commensurate increase in the pressure applied to the rod by the two feed wheels by urging said one wheel towards the other under greater force.

7. A machine according to claim 1 wherein a guard arrangement is provided which is moved to an operative position in which it prevents access to the operating locality of the machine, prior to relative movement of approach taking place between the shoe support and the support arrangement.

8. A machine according to claim 7 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, in said region, said means being mounted on the support arrangement for bodily movement heightwise between an operative position, in which said means can be caused to operate as aforesaid, and a retracted position, and wherein a guard arrangement is provided which is moved to an operative position, in which it prevents access to the operating locality of the machine, prior to the operation of the second gripping and tensioning means.

9. A backpart moulding and heel seat lasting apparatus comprising two machines according to claim 1 arranged side-by-side, wherein the support arrangement of each of said machines is mounted for transverse movement relative to the shoe support in a direction towards the other machine, and further wherein a shoe-receiving device is disposed between the two machines for receiving a shoe from either of them when the support arrangement thereof is moved transversely as aforesaid.

10. A machine according to claim 1 wherein the means for moving the last pin heightwise in a direction away from the wiper plates as aforesaid is caused to operate prior to the release of the heel band and retraction of the wiper plates.

11. A machine according to claim 10 further comprising first timer means actuatable in response to actuation of the means for effecting relative movement of approach between the shoe support and the support arrangement as aforesaid and effective, upon timing out, to cause the heel band to be released and the wiper plates to be retracted, and second timer means actuatable in timed relation with the application of increased pressure to the shoe support, wherein, if the first timer means times out before the second, the release of the heel band and retraction of the wiper plates is delayed until the relative movement of separation between the shoe support and the support arrangement has been completed.

12. A machine according to claim 10 wherein timer means is provided whereby the release of the heel band and retraction of the wiper plates can be delayed for a predetermined period following the heightwise movement of the last pin as aforesaid.

13. A machine according to claim 12 wherein actuation of the timer means takes place in timed relation with the timing out of further timer means which is itself actuated in response to the actuation of the means for effecting relative movement of approach between the shoe support and the support arrangement as aforesaid.

14. A machine according to claim 1 wherein selector means is provided whereby the means for moving the last pin heightwise can be caused to operate to move it in a direction away from the wiper plates as aforesaid selectively either prior to the release of the heel band and retraction of the wiper plates relative to the support arrangement or after such release and retraction.

15. A machine according to claim 14 wherein timer means is provided whereby, when the selector means is set to cause the heightwise movement of the last pin to take place as aforesaid prior to the release of the heel band and retraction of the wiper plates, such release and retraction can be delayed for a predetermined period following such heightwise movement.

16. A machine according to claim 15 wherein actuation of the timer means takes place in timed relation with the timing out of further timer means which is itself actuated in response to the actuation of the means for effecting relative movement of approach between the shoe support and the support arrangement as aforesaid.

17. A machine according to claim 1 further comprising first timer means actuatable in response to actuation of the means for advancing the heel band as aforesaid and effective, upon timing out, to cause the heel band to be released and the wiper plates to be retracted, and second timer means actuatable in timed relation with the application of increased pressure to the shoe support, wherein, if the first timer means times out before the second, then if the selector means is set to cause the heightwise movement of the last pin to take place prior to the release of the heel band and the retraction of the wiper plates, such release and retraction is delayed until relative movement of separation between the shoe support and the support arrangement has been completed, and if the selector means is set to cause said heightwise movement to take place after such release and retraction, the latter is delayed until the application of bedding pressure is terminated.

18. A machine according to claim 1 wherein relative movement of separation between the shoe support and the support arrangement takes place in a direction extending transversely of the bottom of a shoe supported by the shoe support.

19. A machine according to claim 18 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, in said region, said means being mounted on the support arrangement for bodily movement heightwise between an operative position, in which said means can be caused to operate as aforesaid, and a retracted position, and wherein the second gripping and tensioning means comprises two grippers arranged to lie one at either side of the shoe support when in operative position, each gripper comprising two jaws one of which is movable relative to the other to effect opening and closing of the gripper, and means for effecting movement of grippers in a direction widthwise of the shoe, and further wherein each movable jaw has an abutment mounted for movement therewith and engageable with the side of the shoe for positioning the gripper widthwise of the shoe, the arrangement being such that when the gripper is closed the abutment is moved to an out-of-the-way position in which it lies outside the path of advancing movement of the heel band, and also wherein the abutment of each gripper is moved to its out-of-the-way position as transverse relative movement of approach takes place between the shoe support and the support arrangement.

20. A machine according to claim 18 wherein the support arrangement comprises a frame between which and the shoe support transverse movement can take place as aforesaid to move them between an operative position, in which the heel band assembly and the wiper assembly can operate on a shoe supported by the shoe support, and said spaced relationship, and a carriage movable towards and away from the shoe support in the frame and supporting the heel band assembly and the wiper assembly for bodily movement between an advanced and a retracted position, the advanced position being determined, when the frame and shoe support are in said operative position, by engagement of the heel band with the heel end of a shoe supported by the shoe support and thus determining the operative relationship between the shoe support and the support arrangement as aforesaid.

21. A machine according to claim 20 wherein, for effecting such transverse movement, the support arrangement is mounted for pivotal movement about an axis extending heightwise of the bottom of a shoe supported by the shoe support.

22. A machine according to claim 20 wherein the heel band assembly also comprises band clamping means by which, after the band has engaged the shoe as aforesaid, the sides of the band are clamped against the sides of the shoe, and wherein, after the last pin has been moved out of its operative position and prior to the transverse movement of the support arrangement, the carriage of the latter is moved to its retracted position, while the band clamping means maintains the heel band in clamping engagement with the shoe.

23. A machine according to claim 22 wherein the carriage is returned to its advanced position, after the support arrangement has moved transversely out of its operative relationship with the shoe support, the band clamping means being operated to release the shoe from the heel band thus to allow the shoe to fall into a receptacle which is located beneath the support arrangement, when the latter is in its spaced relationship with the shoe support.

24. A backpart moulding and heel seat lasting apparatus comprising two machines according to claim 23 arranged side-by-side, wherein the support arrangement of each of said machines is mounted for transverse movement relative to the shoe support in a direction towards the other machine, the receptacle being disposed between the two machines for receiving a shoe from either of them when the support arrangement thereof is moved transversely as aforesaid.

25. An apparatus according to claim 24 wherein the carriage of each support arrangement is returned to its advanced position and the band clamping means is operative to release the shoe when the support arrangement is moved transversely as aforesaid, and further wherein control means is provided which, where both support arrangements have been moved transversely as aforesaid, prevents the return of the carriage of one of said arrangements to its advanced position, if such movement of the carriage of the other arrangement has already been initiated.

26. A machine according to claim 22 wherein the wiper plates are also maintained in their forward and inward position over the heel seat of the shoe during the retraction of the carriage.

27. A machine according to claim 26 wherein the retraction of the wiper plates is initiated before the release of the heel band.

28. A machine according to claim 1 wherein a receptacle for a shoe is provided, which receptacle is located beneath the support arrangement, when the latter is in its spaced relationship with the shoe support.

29. A machine according to claim 1 wherein the holddown is mounted on the support arrangement for movement between an operative position, in which it serves to determine the heightwise position of the heel seat of a shoe supported by the shoe support, and a retracted position.

30. A machine according to claim 29 wherein the holddown is moved to its operative position when relative movement of approach has been effected between the shoe support and the support arrangement.

31. A backpart moulding and heel seat lasting machine comprising a shoe support for supporting, bottom uppermost, a shoe comprising a shoe upper on a last and an insole on the last bottom, said support comprising a last pin which is received in a last pin hole formed in the crown of the last, a holddown by which the heightwise position of the heel seat of a shoe supported by the shoe support is determined, the shoe support also comprising means for moving the last pin heightwise into and out of an operative position determined by the engagement of the heel seat of said shoe with the holddown, a heel band assembly mounted on a support arrangement for sliding movement towards and away from the shoe support between an advanced position and a retracted position, said assembly comprising a heel band which provides a moulding surface shaped complementarily to the heel end of the shoe to be operated upon and by which said heel end can be clamped and moulded, a wiper assembly also mounted on the support arrangement and comprising a pair of wiper plates and means for effecting forward and inward movement thereof whereby the wiper plates are effective to cause heel seat lasting marginal portions of the upper of a shoe the heel end of which has been clamped as aforesaid to be wiped over and pressed against corresponding marginal portions of the insole of said shoe whereby, with adhesive applied therebetween, said marginal portions are bonded together, said means also being effective to cause the wiper plates to be retracted at the end of their operation and the arrangement being such that, with the wiper plate in an overwipe condition, the holddown is retracted and increased pressure is applied to the shoe support thus to apply a bedding pressure to said marginal portions, means for effecting relative movement between the shoe support and the support arrangement into and out of an operative position, in which the heel end of a shoe supported by the shoe support is in opposed relationship with the heel band assembly and the wiper assembly, means for effecting sliding movement of the heel band assembly from its retracted position to its advanced position, in which, when the shoe support and support arrangement are in said operative position, said heel band assembly engages the heel end of the shoe, and band clamping means, forming part of the heel band assembly, for clamping the sides of the heel band against the shoe after such engagement with the heel end thereof, wherein, with a shoe held clamped by the heel band, the wiper plates in overwipe condition and the holddown in its retracted condition, the last pin is retracted from the shoe last, whereafter relative movement is effected between the shoe support and the support arrangement out of said operative position thus to allow the continued moulding of the backpart of the shoe and consolidation of the bond of said marginal portions while a further shoe is being loaded on the shoe support.

32. A machine according to claim 31 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, and in said region, said means being mounted on the support arrangement for bodily movement heightwise between an operative position, in which said means can be caused to operate as aforesaid, and a retracted position.

33. A machine according to claim 32 wherein the second gripping and tensioning means comprises two grippers arranged to lie one at either side of the shoe support when in operative position, each gripper comprising two jaws one of which is movable relative to the other to effect opening and closing of the gripper, and means for effecting movement of the grippers in a direction widthwise of the shoe, and further wherein each movable jaw has an abutment mounted for movement therewith and engageable with the side of the shoe for positioning the gripper widthwise of the shoe, the arrangement being such that when the gripper is closed the abutment is moved to an out-of-the-way position in which it lies outside the path of advancing movement of the heel band.

34. A machine according to claim 31 wherein adhesive-applying means is mounted on the support arrangement for applying adhesive to the heel seat of the shoe prior to the initiation of the inwiping movement of the wiper plates, said means comprising an imprinter nozzle mounted for movement between an operative position, in which it can engage the heel seat of a shoe supported by the shoe support, and a retracted position.

35. A machine according to claim 34 wherein the adhesive-applying means also comprises a melt chamber, and a feed device for feeding adhesive in rod form to said chamber, said device comprising two feed wheels each having a rod-gripping surface, between which wheels the rod can be inserted and by which it is fed, and a drive arrangement, including an n.c. motor, for driving the wheels in accordance with a programmed instruction.

36. A machine according to claim 35 wherein the one feed wheel is supported on a lever for movement towards and away from the other wheel, and the drive arrangement comprises, for said one feed wheel, a belt-and-pulley arrangement which is so arranged that an increase in the resistance of the rod to being fed causes a commensurate increase in the pressure applied to the rod by the two feed wheels by urging said one wheel towards the other under greater force.

37. A machine according to claim 31 wherein a guard arrangement is provided which is moved to an operative position, in which is prevents access to the operating locality of the machine, prior to relative movement of approach taking place between the shoe support and the support arrangment.

38. A machine according to claim 37 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, in said region, said means being mounted on the support arrangement for bodily movement heightwise between an operative position, in which said means can be caused to operate as aforesaid, and a retracted position, and wherein a guard arrangement is provided which is moved to an operative position, in which it prevents access to the operating locality of the machine, prior to the operation of the second gripping and tensioning means.

39. A backpart moulding and heel seat lasting apparatus comprising two machines according to claim 37 arranged side-by-side, wherein the support arrangement of each of said machines is mounted for transverse movement relative to the shoe support in a direction towards the other machine, and further wherein a shoe-receiving device is disposed between the two machines for receiving a shoe from either of them when the support arrangement thereof is moved transversely as aforesaid.

40. A machine according to claim 31 wherein timer means is provided whereby the release of the heel band and retraction of the wiper plates is delayed for a predetermined period following the retraction of the last pin as aforesaid.

41. A machine according to claim 31 wherein first timer means is provided actuatable in response to actuation of the means for effecting relative movement between the shoe support and the support arrangement into said operative position and effective, upon timing out, to cause the heel band to be released and the wiper plates to be retracted, and second timer means actuatable in timed relation with the application of increased pressure to the shoe support, wherein, if the first timer means times out before the second, the release of the heel band and retraction of the wiper plates is delayed until the relative movement between the shoe support and the support arrangement out of said operative position has been completed.

42. A machine according to claim 31 further comprising first timer means actuatable in response to actuation of the means for advancing the heel band as aforesaid and effective, upon timing out, to cause the heel band to be released and the wiper plates to be retracted, and second timer means actuatable in timed relation with the application of increased pressure to the shoe support, wherein the release of the heel band and the retraction of the wiper plates are delayed until relative movement between the shoe support and the support arrangement out of said operative position has been completed.

43. A machine according to claim 31 wherein the wiper assembly is mounted for sliding movement bodily with the heel band assembly and further wherein, prior to relative movement being effected between the shoe support and the support arrangement out of said operative position but after retraction of the last pin, the heel band assembly and wiper assembly are moved bodily into their retracted position.

44. A machine according to claim 43 wherein relative movement between the shoe support and the support arrangement takes place in a direction extending transversely of the bottom of a shoe supported by the shoe support.

45. A machine according to claim 44 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, in said region, said means being mounted on the support arrangement for bodily movement heightwise between an operative position, in which said means can be caused to operate as aforesaid, and a retracted position, and wherein the second gripping and tensioning means comprises two grippers arranged to lie one at either side of the shoe support when in operative position, each gripper comprising two jaws one of which is movable relative to the other to effect opening and closing of the gripper, and means for effecting movement of the grippers in a direction widthwise of the shoe, and further wherein each movable jaw has an abutment mounted for movement therewith and engageable with the side of the shoe for positioning the gripper widthwise of the shoe, the arrangement being such that when the gripper is closed the abutment is moved to an out-of-the-way position in which it lies outside the path of advancing movement of the heel band, and also wherein the abutment of each gripper is moved to its out-of-the-way position as transverse relative movement of approach takes place between the shoe support and the support arrangement.

46. A machine according to claim 43 wherein the support arrangement comprises a frame between which and the shoe support transverse movement can take place as aforesaid to move them into and out of said operative position, in which the heel band assembly and the wiper assembly can operate on a shoe supported by the shoe support, and a carriage movable towards and away from the shoe support in the frame and supporting the heel band assembly and the wiper assembly for bodily movement between said advanced and retracted positions.

47. A machine according to claim 46 wherein, for effecting such transverse movement, the support arrangement is mounted for pivotal movement about an axis extending heightwise of the bottom of a shoe supported by the shoe support.

48. A machine according to claim 31 wherein a receptacle for a shoe is provided, which receptacle is located beneath the support arrangement, when the latter and the shoe support have been moved out of said operative position.

49. A backpart moulding and heel seat lasting apparatus comprising two machines according to claim 48 arranged side-by-side, wherein the support arrangement of each of said machines is mounted for transverse movement relative to the shoe support in a direction towards the other machine, the receptacle being disposed between the two machines for receiving a shoe from either of them when the support arrangement thereof is moved transversely as aforesaid.

50. An apparatus according to claim 49 wherein the carriage of each support arrangement is returned to its advanced position and the band clamping means is operative to release the shoe when the support arrangement is moved transversely as aforesaid, and further wherein control means is provided which, where both support arrangements have been moved transversely as aforesaid, prevents the return of the carriage of one of said arrangements to its advanced position, if such movement of the carriage of the other arrangement has already been initiated.

51. A machine according to claim 31 wherein the holddown is mounted on the support arrangement for movement between an operative position, in which it serves to determine the heightwise position of the heel seat of a shoe supported by the shoe support, and a retracted position.

52. A machine according to claim 51 wherein the holddown is moved to its operative position when relative movement has been effected between the shoe support and the support arrangement into said operative position.

53. A machine according to claim 52 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, in said region, said means being mounted on the support arrangement for bodily movement heightwise between an operative position, in which said means can be caused to operate as aforesaid, and a retracted position, and wherein the machine further comprises first adjustment means for adjusting the operative position of the holddown together with that of the second gripping and tensioning means, and second adjustment means for adjusting the operative position of the second gripping and tensioning means relative to that of the holddown.

54. A backpart moulding and heel seat lasting machine wherein a shoe, comprising a shoe upper on a last and an insole on the last bottom, is supported by a shoe support at a height datum in relation to which a heel band, by which the backpart of the shoe can be clampingly engaged and thus moulded to the last, and also a wiper assembly, by which lasting marginal portions of the backpart of the shoe can be wiped over and pressed against corresponding marginal portions of the insole, are supported by a support arrangement, and wherein, in the operation of the machine, relative movement takes place between the shoe support and the support arrangement between a first relative position thereof, in which the shoe support is rendered accessible for the loading of a shoe thereon, and a second relative position, in which the shoe supported at the height datum is engaged by the heel band, and further wherein, with the shoe clampingly engaged by the heel band and with the wiper assembly in its overwipe condition, relative movement takes place between the shoe support and the support arrangement to said first relative position thereof, whereby, while moulding of said shoe continues, a further shoe can be loaded on the shoe support.

55. A machine according to claim 54 wherein waist gripping and tensioning means is supported by the support arrangement for movement relative thereto between a retracted position, in which said means is positioned during relative movement between the shoe support and the support arrangement, and an operative position, to which said means is moved after such movement has been effected to bring the shoe support and the support arrangement to their second relative position, said means also serving, by being urged to its retracted position after waist portions of the shoe upper have been gripped thereby, to tension the upper on its last.

56. Machine according to claim 54 wherein, for applying adhesive to the heel seat of a shoe supported by the shoe support, adhesive-applying means is supported by the support arrangement and is operable when the shoe support and the support arrangement are in their second relative position with the heel end of the shoe engaged by the heel band but prior to the initiation of the overwiping movement of the wiper assembly.

57. A machine according to claim 54 wherein the shoe support comprises a last pin which is received within a last pin hole formed in the crown of the last, and further wherein means is provided for retracting the last pin prior to relative movement taking place between the shoe support and the support arrangement to said first relative position thereof as aforesaid.

58. A machine according to claim 54 wherein the direction of said relative movement between the shoe support and the support arrangement extends generally transversely of the bottom of a shoe when supported by the shoe support.

59. A machine according to claim 58 further comprising timer means for setting the period during which the heel band clampingly engages the heel end of the shoe and the wiper assembly remains in its overwipe condition, and further timer means is provided for setting the initiation of the relative movement between the shoe support and the support arrangement to the first relative position thereof, wherein if the first-mentioned timer means times out before the further timer means, release of the heel band and retraction of the wiper assembly are delayed until said relative movement between the shoe support and the support arrangement has been completed.

60. A machine according to claim 58 wherein, for effecting relative movement between the shoe support and the support arrangement, the support arrangement is mounted for pivotal movement about an axis extending heightwise of the bottom of a shoe supported by the shoe support.

61. Machine according to claim 54 wherein the heel band is mounted on a carriage supported by the support arrangement for movement between an operative position, in which, with the shoe support and the support arrangement in the second relative position thereof, the heel band engages the heel end of a shoe supported by the shoe support, and a retracted position, in which it will not collide with the heel end of a shoe supported by the shoe support as relative movement is effected between the shoe support and the support arrangement to the first relative position thereof.

62. A machine according to claim 54 wherein timer means is provided for setting the period during which the heel band clampingly engages the heel end of the shoe and the wiper assembly remains in its overwipe condition.

63. Machine according to claim 54 wherein for setting the height datum as aforesaid a holddown is supported by the support arrangement for movement relative thereto into and out of an operative position in which, with the shoe support and the support arrangement in their second relative position, it positions the heel end of a shoe at the height datum by engagement therewith.

64. A machine according to claim 54 wherein a receptacle for finished shoes is located beneath the support arrangement to receive shoes released from the heel band and wiper assembles after relative movement has taken place between the shoe support and the support arrangement to the second relative position thereof.

65. A machine according to claim 30 wherein means is provided for tensioning about its last the upper of a shoe supported by the shoe support, said means comprising first gripping and tensioning means for gripping the upper in the forepart region thereof and applying a tensioning force, lengthwise of the shoe, to the upper to draw the backpart thereof about its last, and also heightwise of the shoe bottom, and second gripping and tensioning means for gripping the upper in the waist region thereof and tensioning it, heightwise of the shoe bottom, in said region, said second gripping and tensioning means being mounted on the support arrangement for bodily movement heightwise between an operative position, in which said means can be caused to operate as aforesaid, and a retracted position, the machine further comprising first adjustment means for adjusting the operative position of the holddown together with that of the second gripping and tensioning means, and second adjustment means for adjusting the operative position of the second gripping and tensioning means relative to that of the holddown.

* * * * *